United States Patent [19]

Forbes, Jr.

[11] Patent Number: 4,944,451

[45] Date of Patent: Jul. 31, 1990

[54] COMPARTMENTED FLANGED TRAY

[75] Inventor: Hampton E. Forbes, Jr., Newark, Del.

[73] Assignee: Westvaco Corporation, New York, N.Y.

[21] Appl. No.: 446,795

[22] Filed: Dec. 6, 1989

[51] Int. Cl.[5] ..... B65D 5/48

[52] U.S. Cl. ..... 229/120.17; 229/114; 229/125.35; 229/186

[58] Field of Search ..... 229/113, 114, 120.16, 229/120.17, 125.35, 186, 902, 906; 206/561

[56] References Cited

U.S. PATENT DOCUMENTS

| | | | |
|---|---|---|---|
| 2,046,485 | 7/1936 | Ringler | 229/120.17 |
| 3,307,767 | 3/1967 | Humphrey et al. | 229/120.17 |
| 3,721,380 | 3/1973 | Meyers | 229/120.17 |
| 3,863,832 | 2/1975 | Gordon et al. | 229/120.17 |
| 4,192,443 | 3/1980 | McLaren | 229/120.17 |
| 4,241,863 | 12/1980 | Faller | 229/120.17 |
| 4,312,451 | 1/1982 | Forbes, Jr. | 206/628 |
| 4,848,648 | 7/1989 | Eisman | 229/114 |

FOREIGN PATENT DOCUMENTS

| | | | |
|---|---|---|---|
| 807106 | 1/1934 | France | 229/120.17 |

*Primary Examiner*—Gary E. Elkins

[57] ABSTRACT

A flanged tray for packaging, storing, heating and serving food products comprises a plurality of compartments with each compartment pair having adjacent foldably attached walls which form a partition panel between the paired compartments. Each compartment includes gusset corner closures to provide a leak proof construction and additional glue tabs may be provided at each corner to reinforce the gussets and support the flange in a substantially horizontally disposed condition for lidding. The blank for constructing the tray is cut and scored to yield adjacent partition panels which remain substantially perpendicular to their base panels and in full face-to-face contact with one another when the tray compartments are formed so that the paired compartments are self supporting.

6 Claims, 3 Drawing Sheets

COMPARTMENTED FLANGED TRAY

BACKGROUND OF INVENTION

The present invention relates generally to the art of food packaging and more particularly to a tray for packaging, storing, heating and serving food.

Tray type containers of the type disclosed herein are well known in the art. They are low in cost, disposable and are adapted to protect the food packaged therein under a variety of heating and serving conditions. Moreover, such containers are capable of being formed on high speed equipment. However, the prior art does not disclose a container which incorporates all of the features of the present invention.

For example, U.S. Pat. Nos. 3,863,832 and 4,848,648 each disclose multiple compartment trays for food service. Containers formed in accordance with the teachings of these patents are acceptable for most purposes, but they have limitations. Note for example that the containers formed in Pat. No. 4,848,648 each have exposed edges on their interior surfaces which render the individual compartments susceptible to leakage and possible contamination of the food packaged therein. Likewise the corner closures of the separate tray compartments in Pat. No. 3,863,832 each have cut edges, which, even though folded to the outside of the tray walls, still provide an opportunity for leakage of any wet or liquid-containing food products packaged therein. Meanwhile in both patents, the individual compartments are slightly spaced from one another with the result that they do not offer or provide support for one another even though they are joined together.

In contrast to the above, the tray type container of the present invention has full gusset corner closures which are leak proof, and where the individual compartments are joined together, the adjoining side walls are arranged to lie in full face-to-face contact so that the compartments provide support for one another and keep the separate compartments from collapsing. In addition, the container of the present invention utilizes either a separate or integral lid with easy opening features.

SUMMARY OF INVENTION

According to the present invention, a tray type container is disclosed for the packaging of food products, and more particularly for the packaging, storing, heating and serving of food products that require a leak proof enclosure.

The invention comprises an open top, flanged tray having multiple compartments separated from one another by partition panels and either a separate or integral easy to open lid that is common to the multiple compartments. Each compartment includes upstanding side walls foldably attached along opposed score lines to separate base panels with adjacent side walls of each compartment foldably attached to one another to form a partition between paired compartments. The upstanding side walls are further interconnected to one another by gusset panels at each corner which are bonded together and to an adjacent side wall. Meanwhile each of the upstanding side walls of each tray compartment, except for the side walls which form the partition panels, include flap extensions that are foldably attached to the upper edges thereof to form a peripheral flange around the tray. The flap extensions overlap one another at each corner of the tray and are bonded together to reinforce the peripheral flange. In addition, to further reinforce the gusset panel corner closures, in some embodiments of the present invention, at least one gusset panel at each corner of each tray compartment includes a glue tab which is sealed to the underside of the tray flange adjacent to the gusset panel.

The container of the present invention may be closed with a single, integral lid attached to the free upper edge of one compartment side wall and sized so as to cover all compartments of the tray when the lid is sealed to the upper surface of the tray flange. Alternatively, a single separate lid, sized to cover all compartments and to overlap the tray flange, may be used which is sealed to the upper surface of the tray flange. In either case, the lid is provided with an easy opening scheme. For instance, spaced microcuts may be applied to the inner and outer surfaces of the lid structure to create an area of weakness therebetween which delaminates when the lid is removed. Alternatively, microcuts may be applied either on the inside surface of the lid where it is joined to the tray flange, or along the score lines connecting the flange extensions to the side walls. These microcuts also weaken the paperboard in the area adjacent to where they are applied which permits the paperboard in that area to delaminate easily when the lid is removed. Finally, the blank for the container of the invention is cut and scored to provide that all upstanding side walls of each separate compartment, except for the side walls of an adjacent pair of compartments which form partial panels, extended upwardly from the base panels at an oblique angle with respect to the base panels to enable the formed trays to be nested prior to use while the side walls which form the partition panels extend upwardly at a right angle from the base panels so these walls may lie in side- by-side self supporting relation. The arrangement of the score lines to accomplish this result is fully disclosed in applicant's prior U.S. Pat. No. 4,312,451 entitled "Self Standing Flange Tray With Integral Lid".

Accordingly, the present invention provides a unique tray type container which is readily formed, filled and sealed on conventional equipment. In addition, the tray type container of this invention provides versatility in its usefulness for storing, heating and serving food products. Finally, the container disclosed herein is provided with a convenient opening scheme whereby filled containers may be opened simply by lifting one corner of the lid without the use of knives or the like.

Additional details of the invention will be disclosed in the following detailed description, taken in conjunction with the accompanying drawing.

DETAILED DESCRIPTION

Figure 1:
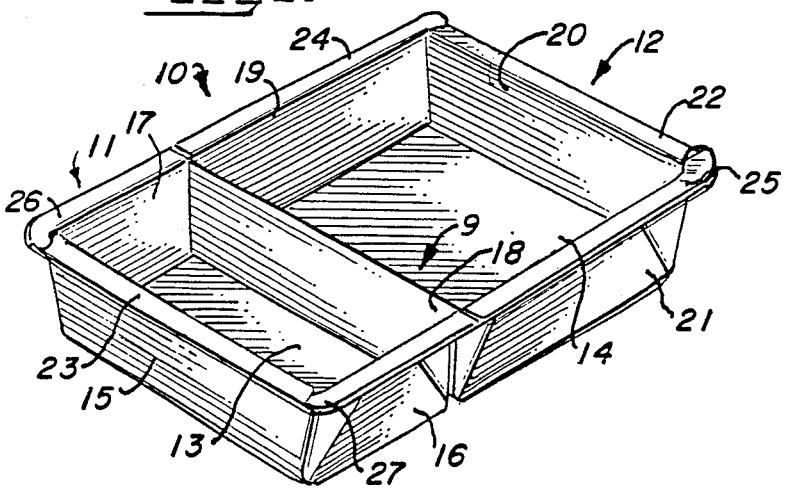
FIG. 1 is a perspective view of a tray type container according to the present invention.

A preferred embodiment of the present invention is illustrated in FIG. 1 wherein there is shown a flanged tray 10 having two compartments 11 and 12 separated by a transverse partition 9. Compartment 11 includes a rectangular base panel 13 with a plurality of upstanding side walls 15, 16, 17 and 18 foldably connected thereto along opposed fold lines. Each of the side walls 15, 16 and 17 also include flange extensions 23, 26 and 27 foldably attached to the upper edges thereof that are disposed in the set up condition for the tray in a plane substantially parallel to the base panel 13. Meanwhile side wall 18 is foldably attached along its upper edge to a corresponding side wall 28 of the adjacent compartment 12 to form the partition element 9. In like manner, the compartment 12 includes a base panel 14 with side walls 19, 20, 21 and 28 foldably attached to opposed edges thereof and flange extensions 22, 24 and 25 foldably attached to the upper free edges of side walls 19, 20 and 21. The side walls of each compartment 11 and 12 including the partition element side walls 18 and 28 are foldably connected to one another and at their ends by leak proof gusset corner closures 29, 30, 31, 32 and 33, 34, 35 and 36 as shown in the blank structure of FIG. 2 and in other Figures. In accordance with an important feature of the present invention, the side walls 15, 16 and 17 of compartment 11, and 19, 20 and 21 of compartment 12 are divergently disposed from their respective base panels 13 and 14 along a slight angle, while the adjacent partition element side walls 18 and 28 of each compartment are substantially perpendicular to their respective base panels 13, 14. The divergently disposed side walls of each compartment permit the tray 10 to be stacked or nested for storage while the substantially straight or perpendicular side walls 18 and 28 remain in full contact with one another when the compartments are filled to provide stability and reinforcement for the tray structure. The fact that these compartments each contain side walls that are permitted to lie in full face-to-face contact serves to prevent the tray compartments from collapsing toward one another when one corner of the tray is lifted or when the tray is opened.

Figure 2:
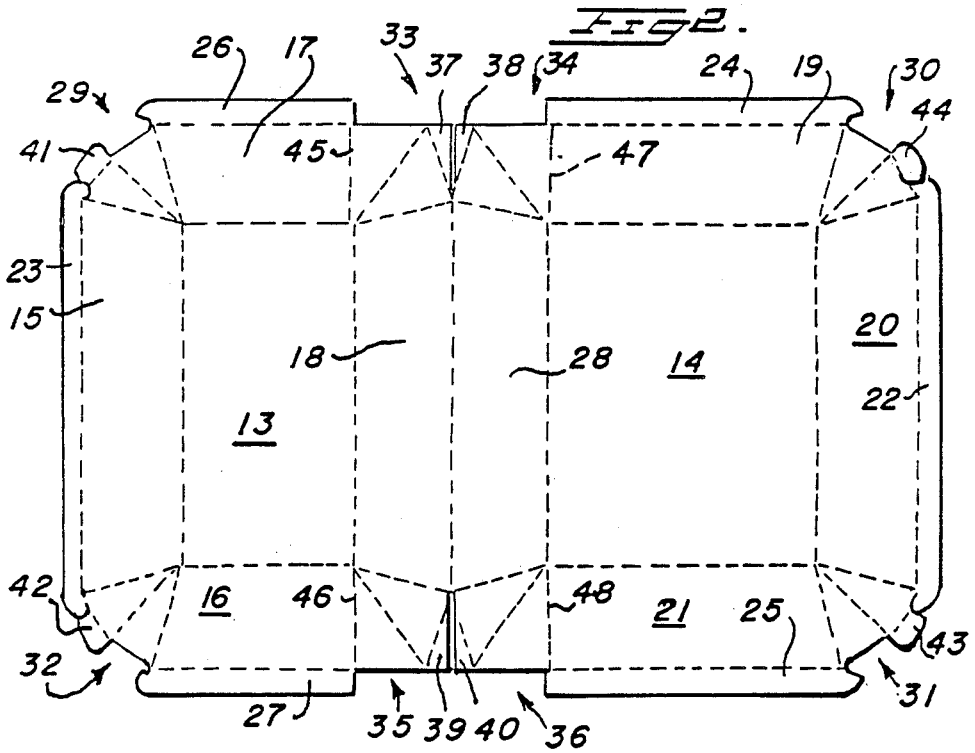
FIG. 2 is a plan view of a blank structure for constructing the container of FIG. 1.

Referring to the blank structure in FIG. 2, it will be noted that the gusset corner closures 29, 30, 31 and 32 are substantially identical and connect the side walls 16 and 17 to side wall 15, and side walls 19 and 21 to side wall 20. These connections are made along score lines which diverge with regard to the score lines connecting the side walls to the base panels 13 and 14 in order to achieve the nesting capability of the trays. In like manner the gusset corner closures 33, 34, 35 and 36 are also substantially identical for connecting the side walls of the adjacent compartments 11 and 12 to the partition panels 18 and 28. However, in order to render the partition panels 18 and 28 substantially straight and perpendicular to the base panels 13 and 14, the score lines 41, 42, and 43, 44 are straight extensions of the score lines which connect the partition panels 18 and 28 to the base panels 13 and 14. This orientation of the score lines at each corner permits the blank to be folded and produce substantially straight or perpendicular partition panels with divergent side walls for the remainder of the tray compartments. It will also be noted in FIG. 2 that at least one panel of each gusset closure includes an additional tab for example, tab 41 for gusset 29: tab 44 for gusset 30; tab 43 for gusset 31; tab 42 for gusset 32; tab 37 for gusset 33: tab 38 for gusset 34; tab 39 for gusset 35; and tab 40 for gusset 36. These tabs are provided on the gusset panels to act as glue flaps which are adhered or sealed to the lower surfaces of the flange extensions of adjacent side walls when the tray is formed. These glue flaps in conjunction with overlapping extensions at the ends of each flange tend to reinforce the gusset corner closures and keep the flange in its desired substantially horizontal plane when the tray is filled and the lids are applied.

Figure 3:
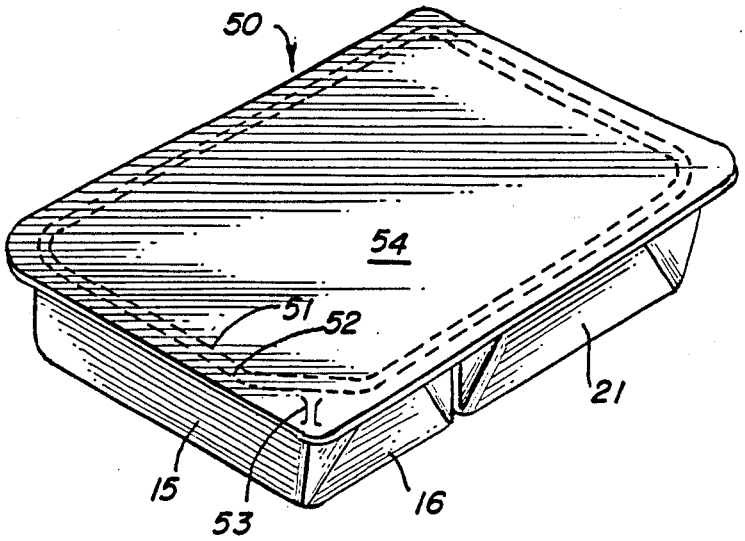
FIG. 3 is a perspective view of a closed container as shown in FIG. 1.
Figure 4:
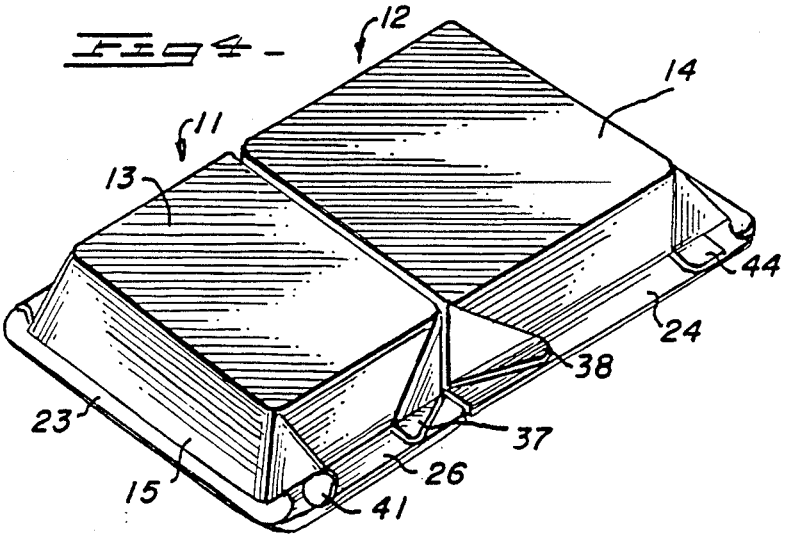
FIG. 4 is a perspective view of the bottom of the container in FIG. 3 showing the glued reinforcing tabs for each corner closure.

FIG. 3 illustrates a typical lid structure useful for closing the tray of the present invention. The lid 50 is of sufficient size to cover the entire flange area of the tray. To assist in opening the lid, a pair of microcuts 51, 52 are applied to the inner and outer surfaces of the lid in the region inside of the peripheral area where the lid is bonded either with adhesive or with a heat seal to the flange portions 23, 26 and 27 of compartment 11, and 22, 24, 25 of compartment 12. When microcuts are used as shown, the paperboard in that area delaminates and the portion of the lid bonded to the flange remains adhered thereto when the central portion 54 of the lid is removed. A pair of cuts 53 at one corner of the lid are provided to initiate the lid removal. It will be understood that the use of microcuts is merely one form of an easy opening method for the present invention and other related easy opening schemes could be applied to the lid structure within the scope of this invention. For instance a single microcut in the bottom surface of the lid adjacent to the inside edge of the flange could be used or a microcut along the fold line connecting the flanges to the side walls of each tray compartment would provide a satisfactory easy opening feature. Meanwhile in FIG. 4, the bottom of the sealed tray of FIG. 3 is shown to illustrate the location of the glue flaps 37, 38 and 41, 44 which are adhered to the bottom of the flanges 24, 26. These glue flaps stabilize the flange and keep it in a generally horizontal plane for easy lifting of the filled trays.

Figure 5:
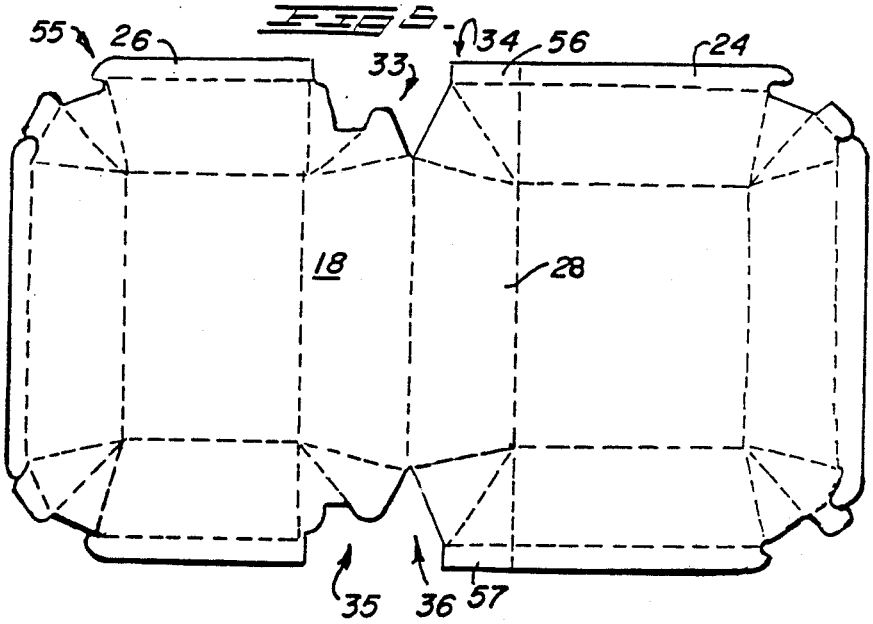
FIG. 5 is a plan view of a modified blank structure.
Figure 6:
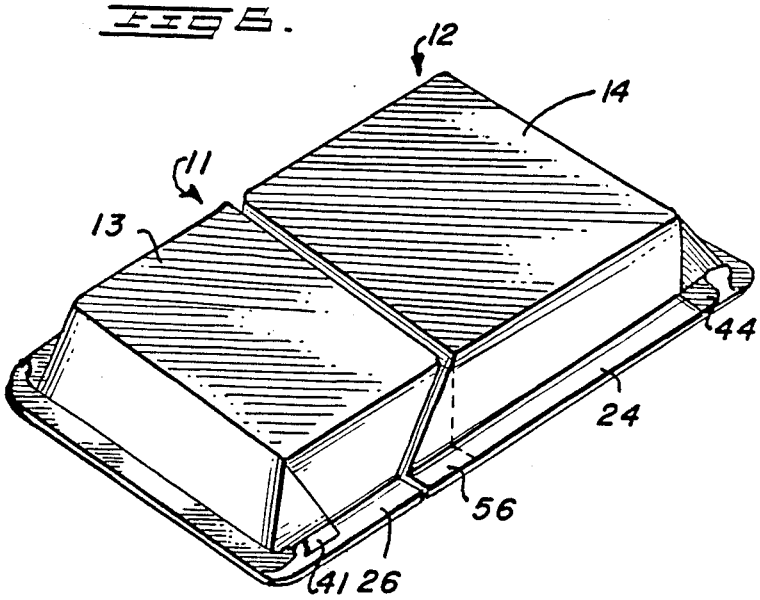
FIG. 6 is a perspective view of the bottom of a container formed from the blank of FIG. 5.

FIG. 5 illustrates a modified construction of the blank for the tray of the present invention where it is desired to further reinforce the relationship between the two compartments of a single tray. The basic blank structure 55 of FIG. 5 is similar to the blank structure shown in FIG. 2, except for the addition of two flange glue tabs 56, 57 and the configuration of the gusset closures 33, 34 and 35, 36 between the partition walls 18 and 28. In this case, a pair of glue tabs 56, 57 are included on the gusset closures 34, 36 of compartment 12 which are adhered to the underside of the flange extensions 26, 27 of compartment 11. In addition, the gusset panels of gusset closures 33, 35 are revised to permit the gusset panels of gusset closures 34, 36 to overlap and be adhered to the outer surface of gusset closures 33, 35. The final construction is shown in FIG. 6 and provides an embodiment of the present invention wherein the two compartments of the tray are rigidly attached together. In this embodiment of the invention, the two compartments retain their straight, adjacent partition walls but the formed trays are no longer nestable for stacking.

Other embodiments contemplated by the present invention are constructions where the score lines are arranged so that each of the front, partition and rear walls of a single tray are all arranged generally perpendicular to their base panels while the side walls diverge therefrom. In addition, it will be understood that modifications to the gusset closures can be made within the scope of the present invention to accommodate different types of forming equipment.

Accordingly there has been described herein a new and improved food package comprising a multiple compartment tray for packaging, storing, heating and serving food products. The tray may include a separate or integral lid with an easy opening feature and the blank structure for forming the tray is cut and scored to produce leak proof compartments with outer walls that diverge with respect to the base panels and non-diverging adjacent walls that are substantially perpendicular to the base panels. Thus while the invention has been fully described in connection with a preferred embodiment, it will be understood that it is intended to cover all modifications and equivalents that fall within the spirit and scope of the appended claims.

What is claimed is:

1. A flanged tray for packaging, storing, heating and serving food prepared from a single blank of paperboard, said tray comprising multiple leakproof compartments with partitions between each adjacent pair of compartments, said flanged tray comprising:

(a) a base panel for each compartment formed by opposed score lines:

(b) upstanding side walls foldably attached to each base panel along said opposed score lines said side walls terminating at upper free edges wherein the adjacent walls of each pair of compartments are foldably attached to one another along their upper free edges to form partitions between each pair of compartments:

(c) flap extensions foldably attached to the upper free edges of all side walls of each compartment except the tray walls which form each partition to provide a peripheral flange around the tray:

(d) gusset panel corner closures foldably attached to the ends of said side walls at each corner of each base panel along paired score lines which extend from the intersection of said opposed score lines, said gusset panels being overlappingly bonded together and between said side walls to form leak proof corners for the respective compartments, said paired score lines being arranged at the gusset closures between the adjacent compartments to provide partition panels which extend substantially perpendicular from their respective base panels to lie in full face-to-face contact so that the paired compartments provide support for each other.

2. The tray of claim 1 wherein the gusset panel score lines at each corner of each base panel are arranged at oblique angles with respect to the opposed score lines which define each base panel except for one of the gusset panel score lines in each pair which connect the adjacent partition walls of each compartment to its adjacent side wall to yield a construction wherein all except the adjacent partition walls of each compartment are divergent with respect to said base panels.

3. The tray of claim 2 wherein a separate lid is provided for the tray which fits over and is sealed to the peripheral flange area of the tray.

4. The tray of claim 2 wherein an integral lid is provided for the tray which is foldably attached to the upper free edge of one of the side walls and is sized so as to overlap and be sealed to said tray flange to close tray.

5. The tray of claim 2 wherein additional glue flaps are provided integral with the free upper edges of at least one gusset panel at each corner closure which are adhered to the underside of the tray flange to stabilize the flange.

6. The tray of claim 5 wherein the gusset panels of opposed corner closures adjacent to the partition panel of one compartment are folded to overlap and be adhered to the opposed corner closures adjacent to the partition panel of the other compartment.

* * * * *